US008991650B2

(12) United States Patent
Perignon et al.

(10) Patent No.: US 8,991,650 B2
(45) Date of Patent: Mar. 31, 2015

(54) STOPPER MEMBER AND A DISPENSER INCLUDING SUCH A MEMBER

(75) Inventors: Fabrice Perignon, Verneuil sur Avre (FR); Christophe Pierre, Saint-Sebastien-de-Morsent (FR)

(73) Assignee: Aptar France S.A.S., Le Neubourg (FR)

( * ) Notice: Subject to any disclaimer, the term of this patent is extended or adjusted under 35 U.S.C. 154(b) by 124 days.

(21) Appl. No.: 13/547,915

(22) Filed: Jul. 12, 2012

(65) Prior Publication Data

US 2013/0015213 A1 Jan. 17, 2013

Related U.S. Application Data

(60) Provisional application No. 61/514,271, filed on Aug. 2, 2011.

(30) Foreign Application Priority Data

Jul. 13, 2011 (FR) ..... 11 56412

(51) Int. Cl.

| | |
|---|---|
| ***B65D 35/00*** | (2006.01) |
| ***B65D 47/00*** | (2006.01) |
| ***B65D 37/00*** | (2006.01) |
| ***B65D 33/16*** | (2006.01) |
| ***B65D 41/32*** | (2006.01) |
| ***B65D 39/00*** | (2006.01) |
| ***B65D 75/58*** | (2006.01) |

(52) U.S. Cl.

CPC ..... *B65D 75/5883* (2013.01); *B65D 2221/00* (2013.01); *Y10S 383/906* (2013.01)

USPC ..... 222/107; 222/92; 222/546; 222/215; 383/906; 383/80; 220/266; 215/253

(58) Field of Classification Search

USPC ..... 222/107, 563, 541.5, 546, 556, 55, 95, 222/92, 105, 212, 215, 213, 214; 383/906, 383/904, 104, 80, 93, 81, 85, 908; 215/48, 215/253; 220/226, 266, 276

See application file for complete search history.

(56) References Cited

U.S. PATENT DOCUMENTS 5,911,340 A * 6/1999 Uematsu ..... 222/92
6,142,341 A * 11/2000 Uematsu ..... 222/92

(Continued)

FOREIGN PATENT DOCUMENTS

FR 2 781 770 A1 2/2000
FR 2 841 539 A1 1/2004

(Continued)

*Primary Examiner* — Kevin P Shaver
*Assistant Examiner* — Stephanie E Williams
(74) *Attorney, Agent, or Firm* — Sughrue Mion, PLLC

(57) ABSTRACT

A stopper for being sealed between two sheets of a reservoir, including a body defining a front face, rear face, internal edge, and external edge. The body forms a dispenser orifice that passes through from the rear face to the front face, the front and rear faces defining front and rear heat-sealing zones for the sheets. The front face defines a fluid collection zone at the orifice and the rear face defines a fluid delivery channel that extends from the dispenser orifice to the internal edge of the body. A closure lid is provided, the lid connected to the base body via a hinge. The body defines tapering side edges where the front and rear heat-sealing zones are contiguous, and the front and rear faces are convex, to define a maximum thickness where the dispenser orifice, the delivery channel, and a fraction of the collection zone are formed.

11 Claims, 2 Drawing Sheets

(56) References Cited

U.S. PATENT DOCUMENTS

| | | | | |
|---|---|---|---|---|
| 6,598,808 | B1 | 7/2003 | Garcia | |
| 6,958,033 | B1 * | 10/2005 | Malin | 493/102 |
| 7,762,414 | B2 * | 7/2010 | Uytterhaeghe et al. | 215/253 |
| 2004/0000561 | A1 * | 1/2004 | Lallemant et al. | 222/92 |
| 2007/0012644 | A1 * | 1/2007 | Uytterhaeghe et al. | 215/48 |
| 2007/0263947 | A1 | 11/2007 | Duquet et al. | |
| 2010/0211033 | A1 * | 8/2010 | Blum | 604/335 |

FOREIGN PATENT DOCUMENTS

| | | | |
|---|---|---|---|
| FR | 2 900 132 | A1 | 10/2007 |
| GB | 2 416 156 | A | 1/2006 |

* cited by examiner

STOPPER MEMBER AND A DISPENSER INCLUDING SUCH A MEMBER

CROSS REFERENCE TO RELATED APPLICATIONS

This application claims priority from French Patent Application No. 11 56412, filed on Jul. 13, 2011 and U.S. provisional application 61/514,271 filed on Aug. 2, 2011, the contents of all of which are incorporated herein by reference in their entirety.

TECHNICAL FIELD

The present invention relates to a stopper member for being sealed or heat-sealed between two sheets of a fluid reservoir, said member comprising: a base body defining a front face, a rear face, an internal edge, and an external edge, the body forming a fluid dispenser orifice that passes through the body from the rear face to the front face; and a closure lid for closing the dispenser orifice of the base body on the front face, the lid being connected in integral manner to the base body via a hinge.

BACKGROUND OF THE INVENTION

The present invention also relates to a fluid dispenser comprising a reservoir that is associated with a stopper member of the invention. This type of single-part stopper member finds an advantageous application in the fields of cosmetics, pharmacy, or even perfumery for dispensing fluids that are preferably viscous. By way of example, it is possible to package a cream sample in a dispenser fitted with such a stopper member.

In the prior art, sample-type dispensers are already known comprising a thermoformed shell, a flexible sheet, and a stopper member that is fastened between the thermoformed shell and the flexible sheet. The stopper member includes a dispenser orifice that is possibly associated with a part made out of porous material, as in document FR-2 780 770, for example. Document FR-2 841 539 is also known, which describes a dispenser comprising a stopper member that is fastened to one of the two sheets of a reservoir. The stopper member includes a dispenser orifice that may be closed by a removable closure lid. Document FR-2 900 132 is also known, which describes another stopper member for fastening on a flexible sheet of a reservoir. All of those prior-art stopper members present the drawback of dispensing a small quantity of fluid while the dispenser orifice is being closed. Given that it is necessary to squeeze the two sheets of the reservoir in order to engage the lid in the dispenser orifice, a small quantity of fluid is expelled through the dispenser orifice just before the lid closes it. Thus, once engaged in leaktight manner in the dispenser orifice, the lid expels a small quantity of fluid around the dispenser orifice, such that when next used, dried out or spoilt fluid is present around the dispenser orifice and on the lid. Naturally, this spoilt or dried out fluid residue contaminates the fluid the next time fluid is dispensed from the reservoir. This constitutes a major drawback that is found in most fluid dispensers fitted with such stopper members.

BRIEF SUMMARY OF THE INVENTION

An object of the present invention is to remedy the above-mentioned drawback of the prior art by defining a stopper member in which the operation of closing the dispenser orifice does not lead to a small quantity of residual fluid being expelled. The present invention also makes it possible to achieve other objects, e.g. such as easy mounting of the stopper member between two flexible sheets constituting the reservoir, easy and rapid manufacture of the stopper member by molding by means of a very simple set of molds, easy manipulation of the lid, easy collection of the fluid at the output from the dispenser orifice, etc.

To achieve these various objects, the present invention proposes a stopper member for being sealed between two sheets of a fluid reservoir, said member comprising:

- a base body defining a front face, a rear face, an internal edge, and an external edge, the body forming a fluid dispenser orifice that passes through the body from the rear face to the front face, the front and rear faces defining front and rear heat-sealing zones for the two sheets respectively of the reservoir, the front face defining a fluid collection zone at the dispenser orifice, and the rear face defining a fluid delivery channel that is open along its length and that extends from the dispenser orifice to the internal edge of the base body.
- a closure lid for closing the dispenser orifice of the base body on the front face, the lid being connected in integral manner to the base body via a hinge;

wherein:

- the body defines tapering side edges where the front and rear heat-sealing zones are contiguous, and
- the front and rear faces are convex, in such a manner as to define a maximum thickness, where the dispenser orifice, the delivery channel, and a fraction of the collection zone are formed.

The base body thus presents a section in the shape of an eye or of a shuttle, with a thick central portion and tapering side edges. The maximum thickness of the body may be less than about 5 mm. The two sheets constituting the reservoir, that are heat-sealed on the front and rear faces respectively of the base body, are joined together in leaktight manner at the tapering side edges.

To summarize, the stopper member presents a flat configuration that defines two large faces, a front face and a rear face, that are used for heat-sealing the two sheets of the reservoir, the fluid is collected in a collection zone of the front face, and the stopper member especially presents a delivery channel that is open along its length and closed by one of the sheets of the reservoir, and that connects the dispenser orifice to the internal edge that is situated inside the reservoir. The particular configuration of the delivery channel open along its entire length enables the stopper member to be made by molding a suitable plastics material with a very simple set of molds that comprises only two passive mold imprints that are moved axially relative to each other, like a waffle mold. Naturally, it follows that the manufacture of the stopper member is very simple, very rapid, and very inexpensive.

The delivery channel that is hollowed out in the rear face of the base body and that is open along its entire length, makes it possible to form a small volume that is completed by one of the sheets of the reservoir. Thus, manual pressure applied to the sheet at the delivery channel has only very little effect on the internal volume of the delivery channel. As a result, even when squeezing very hard on the two faces of the base body covered by the two sheets of the reservoir, the delivery channel is subjected to practically no pressure, such that the fluid is not expelled through the dispenser orifice while it is being closed by means of the lid. It is thus this particular configuration of the delivery channel in the form of a recess of small width, covered by one of the sheets of the reservoir that both enables the fluid stored between the two sheets of the reservoir to be delivered properly to the dispenser orifice, and enables the orifice to be closed easily by means of the lid, without risk of an undesirable residue of fluid being expelled.

In a practical embodiment, the front heat-sealing zone surrounds the collection zone, and the rear heat-sealing zone surrounds the delivery channel. One of the flexible sheets of the reservoir stops around the collection zone, while the other sheet of the reservoir extends over the delivery channel in such a manner as to form a delivery duct that connects the dispenser orifice to the internal edge of the base body. Advantageously, the collection zone is hollowed out relative to the front heat-sealing zone. Advantageously, the delivery channel is hollowed out relative to the rear heat-sealing zone. The delivery channel is thus in the form of a recess that is open along its length, and that connects the dispenser orifice to the internal edge of the base body. In another advantageous aspect of the invention, the lid covers substantially all of the collection zone and is advantageously inscribed in the front face. Thus, all of the collection zone is protected by the lid.

Advantageously, the front face defines a projecting ridge that separates the front heat-sealing zone from the collection zone, the ridge advantageously being interrupted locally, in such a manner as to define an access for gripping the lid.

In addition, the lid may be connected to the body via the hinge at the external edge.

The invention also defines a fluid dispenser comprising: a fluid reservoir comprising two flexible sheets; and a stopper member as described above; the flexible sheets being heat-sealed on the front and rear heat-sealing zones respectively of the base body of the stopper member. Advantageously, one of the sheets extends over the delivery channel in such a manner as to define a delivery duct that connects the dispenser orifice to the internal edge. Thus, one of the sheets of the reservoir covers the delivery channel that is open along its length.

A principle of the invention resides in the fact that the stopper member defines a delivery channel that is open along its length, and that connects the dispenser orifice to the inside of the reservoir, the delivery channel being closed by one of the sheets constituting the reservoir. As a result of the small dimensions of the delivery channel, the sheet that covers it cannot be pressed into the channel so as to exert pressure on the fluid that is contained therein. Thus, any risk is avoided of residual fluid being expelled through the dispenser orifice, while the orifice is being closed by means of the lid. Another principle of the present invention is to make the stopper member by injection-molding plastics material by means of a very simple set of molds, comparable to a waffle mold.

BRIEF DESCRIPTION OF THE DRAWINGS

The invention is described more fully below with reference to the accompanying drawings, which show an embodiment of the invention by way of non-limiting example. In the figures.

DETAILED DESCRIPTION

Figure 1:
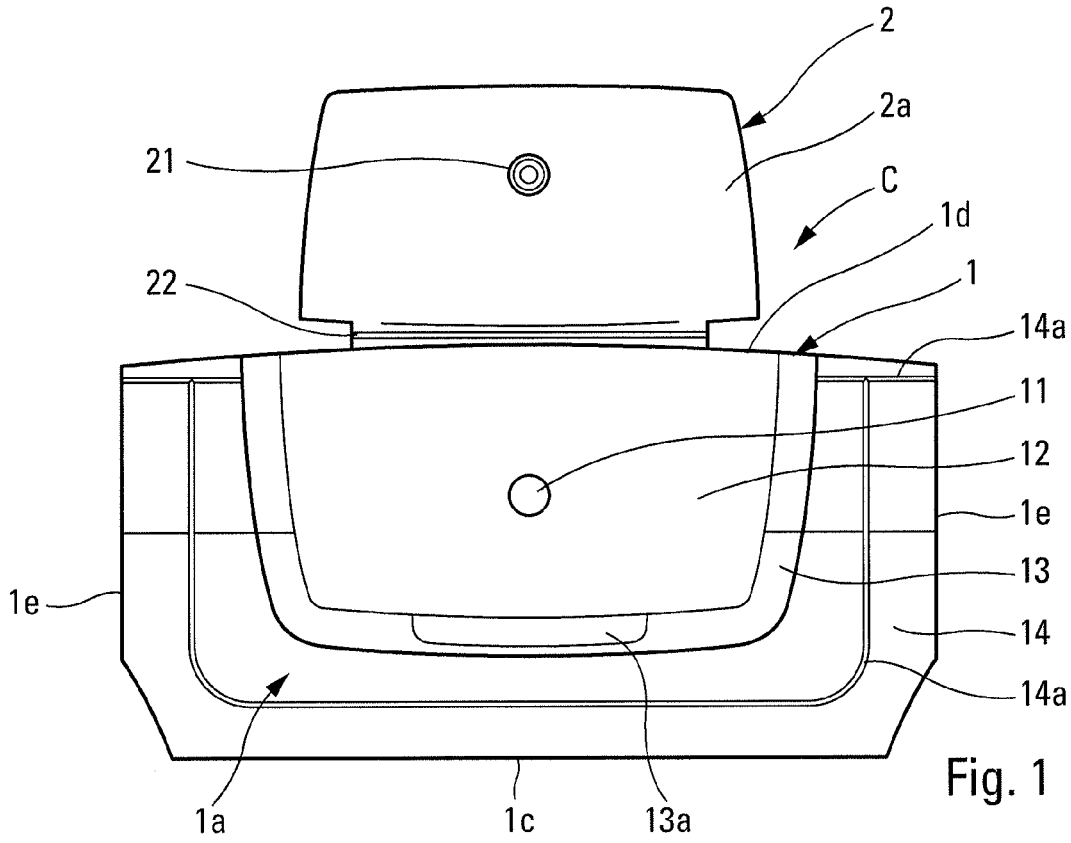
FIG. 1 is a plan view of the front face of a stopper member of the invention.
Figure 2:
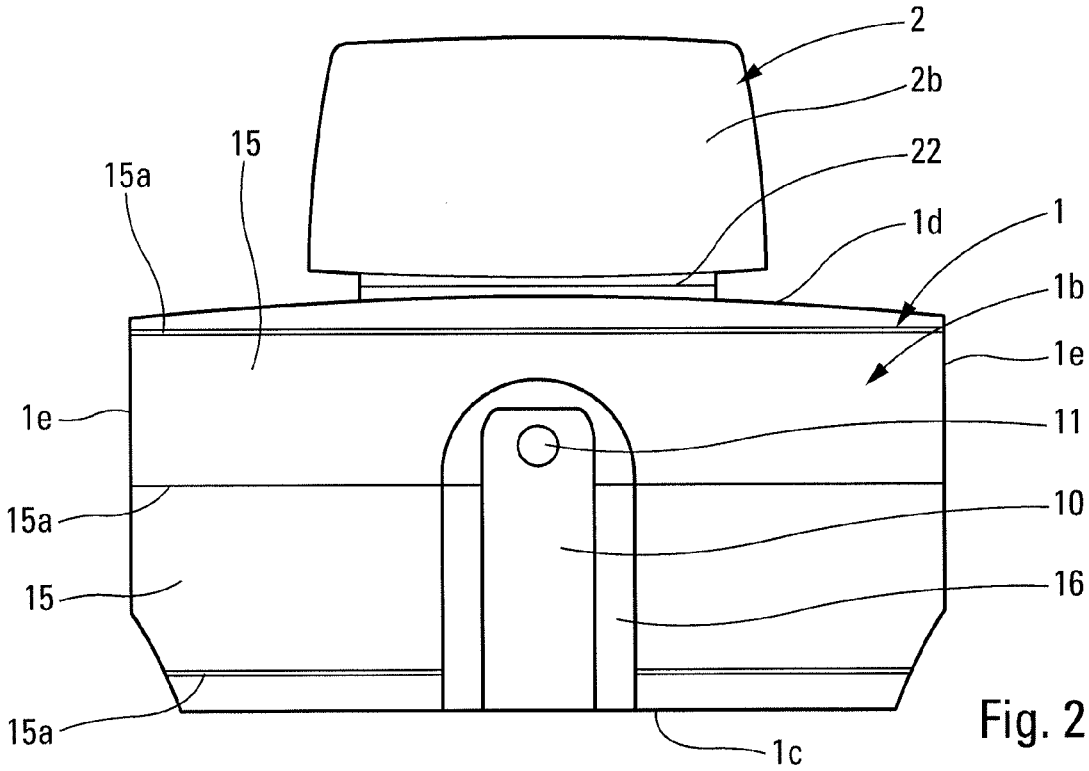
FIG. 2 is a plan view of the rear face of the FIG. 1 stopper member.
Figure 3:
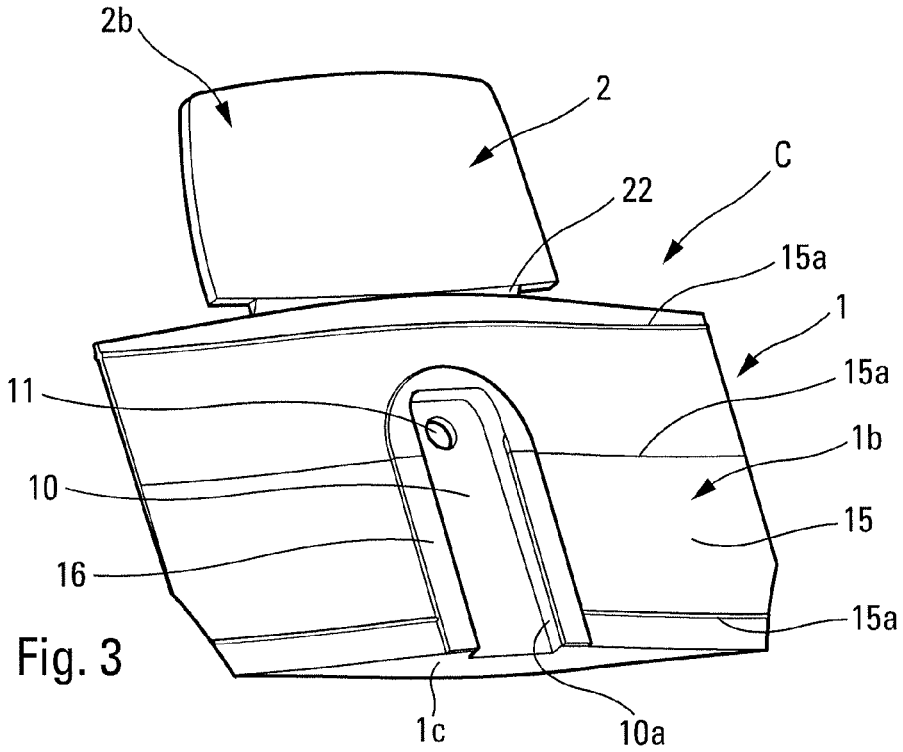
FIG. 3 is a perspective view showing the rear face of the stopper member in FIGS. 1 and 2.

Reference is made initially to FIGS. 1 to 3 in order to describe in detail the structure of a stopper member made in accordance with a non-limiting embodiment of the invention. Preferably, the stopper member is made by injection-molding a suitable plastics material, such as polyethylene, polypropylene, etc. As described below, the set of molds used to mold the stopper member of the invention is particularly simple, as a result of its intrinsic characteristics. Preferably, the stopper member is made as a single part.

In the figures, the stopper member is designated overall by the letter C. It comprises a base body 1 that is connected to a closure lid 2 via a hinge 22 that is in the form of a deformable bridge of material. The hinge 22 connects the base body 1 in integral manner to the closure lid 2. In the figures, the stopper member C is shown in the open position with the closure lid 2 extending substantially in the same plane as the base body 1. It should be observed that the base body 1 and the closure lid 2 present a configuration that is generally substantially plane or flat, such that, in the open state, the closure lid 2 may be disposed substantially in the same plane as the base body 1. This makes it possible to reveal certain characteristics of the base body and of the closure lid.

In this particular embodiment, the base body 1 presents a configuration that is generally substantially rectangular and flat. It comprises a front face 1*a*, a rear face 1*b*, an internal edge 1*c*, an external edge 1*d*, and two tapering edges 1*e*. The hinge 22 that is connected to the closure lid 2 connects the base body 1 at its external edge 1*d*. The base body presents a cross-section in the shape of an elongate eye or of a shuttle, given that its front and rear faces are slightly convex. As a result, in its middle portion, the base body 1 presents a maximum thickness lying in the range about 4 mm to 5 mm. This is more visible in FIG. 5. A dispenser orifice 11 passes through the thickness of the base body and thus puts the front face 1*a* into communication with the rear face 1*b*. The dispenser orifice 11 is made substantially in the center of the base body, at its maximum thickness.

On the front face 1*a*, the dispenser orifice 11 opens out into a collection zone 12 that may be slightly concave. The dispenser orifice 11 may advantageously be situated at the low point of the concave shape of the collection zone 12. The collection zone 12 extends to the external edge 1*d* where the hinge 22 is formed, connecting the closure lid 2. On its other sides, the collection zone 12 is bordered by a projecting ridge 13 that thus defines the collection zone 12. The ridge 13 is formed with an access 13*a* where it is possible to grip the closure lid 2 so as to lift if off the dispenser orifice 11. Around the projecting ridge 13, the front face 1*a* defines a front heat-sealing zone 14 that extends to the internal edge 1*c*, to the tapering edges 1*e*, and to the external edge 1*d*. The front heat-sealing zone 14 may be provided with a plurality of projecting heat-sealing beads 14*a* where the heat-sealing is very good. The projecting ridge 13 projects relative to the front heat-sealing zone 14, as visible in FIG. 5.

The rear face 1*d* of the base body 1 is formed with a delivery channel 10 that extends from the dispenser orifice 11 to the internal edge 1*c*. The delivery channel 10 is hollowed out relative to the remainder of the rear face 1*b*. It may be bordered by a projecting edge 16 in the shape of an upside-down U, as can be seen in FIGS. 2 and 3. The projecting edge 16 projects relative to a rear heat-sealing zone 15 that extends over the remainder of the rear face 1*b*. Thus, the rear heat-sealing zone 15 extends from the internal edge 1*c* to the external edge 1*d*, and from one tapering edge 1*e* to the other. The width of the delivery channel 10 may lie in the range about 2 mm to 7 mm, advantageously in the range about 4 mm to 5 mm. The length of the delivery channel may be about 1.5 centimeters (cm), and its depth may be about 1 mm. The rear heat-sealing zone 15 is also formed with a plurality of beads 15*a* where the heat-sealing is very good. It should be observed that the delivery channel 10 is open along its entire length from the dispenser orifice 11 to the internal edge 1*c*. It is thus in the form of a recess that extends in hollowed out manner relative to the general plane formed by the rear face 1*b*. It should be observed that the flanks 10*a* of the delivery channel 10 extend substantially perpendicularly to the general plane formed by the base body 1. In addition, the dispenser orifice 11 also extends perpendicularly to the general plane formed by the base body 1. In this way, it is possible to make the rear face of the base body with an extremely simple set of molds that does not require a movable drawer or pin. The same applies for the front face 1*a* that may be made with a passive mold imprint. Thus, the base body 1 may be made with an extremely simple set of molds, comparable to a waffle mold.

The closure lid 2 presents dimensions that are less than the dimensions of the collection zone 12, such that the lid 2 may be disposed on the 12 inside of the projecting ridge 13. As a result of the concave shape of the collection zone 12, the lid 2 may be inscribed entirely inside the base body 1, in the closed position. The closure lid 2 includes an inside face 2*a* for coming into contact with the collection zone 12, and an outside face 2*b* that extends substantially flush with the front heat-sealing zone 14. The inside face 2*a* is formed with a closure pin 21 for inserting in leaktight manner in the dispenser orifice 11. The operation of closing and of opening the lid is performed by causing the lid to pivot about the hinge 22.

Figure 4:
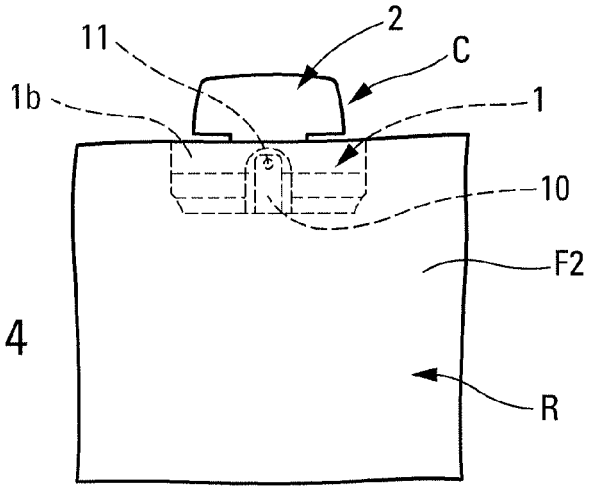
FIG. 4 is a very diagrammatic view of a fluid dispenser comprising two flexible sheets and the stopper member in FIGS. 1 to 3.
Figure 5:
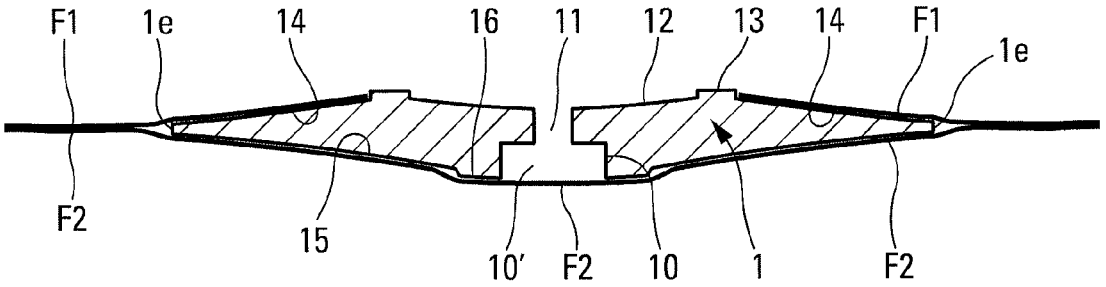
FIG. 5 is a larger-scale cross-section view through the FIG. 4 dispenser at the dispenser orifice of the stopper member of the invention.

The stopper member C may be associated with a fluid reservoir R that comprises two flexible sheets F1, F2 that are heat-sealed together at their periphery, in such a manner as to form a flexible pouch. The rear face of the dispenser is shown in FIG. 4. The stopper member C is inserted between the two sheets F1, F2, and is heat-sealed therebetween at front and rear heat-sealing zones 14, 15. More precisely, as can be seen in FIG. 5, the sheet F1 is heat-sealed on the front heat-sealing zone 14, and the rear sheet F2 is heat-sealed on the rear heat-sealing zone 15. The front sheet F1 is cut out in such a manner as to form a notch that fits around the projecting ridge 13. In other words, the sheet F1 does not extends over the ridge 13, nor over the collection zone 12. In contrast, the rear sheet F2 extends over the rear face 1*b*, covering the projecting edge 16 and especially the delivery channel 10, in such a manner as to close it and thereby create a delivery duct 10' that connects the dispenser orifice 11 to the internal edge 1*c* that is disposed inside the reservoir. The rear sheet F2 may be hermetically sealed on the projecting edge 16, in such a manner as to isolate the delivery duct 10' completely. At the tapering edges 1*e*, the two sheets F1, F2 are joined together in leaktight manner.

As a result of the small dimensions of the delivery channel 10, the portion of the rear sheet F2 that covers it so as to form the delivery duct 10', can be deformed little, if at all, when pressed towards the inside of the channel 10. In other words, the volume of the delivery duct 10 remains practically unchanged, even when manual pressure is exerted on the sheet F2 at the channel 10. As a result, the fluid that is present in the delivery duct 10' cannot be expelled through the dispenser orifice 11 merely by pressing on the portion of the rear sheet F2 that covers the channel 10. Thus, while the dispenser orifice 11 is being closed by means of the lid 2, and while the rear sheet F2 and the lid 2 are being squeezed, there is no risk of expelling fluid through the dispenser orifice 11. This is particularly true when the dispenser is seized with the thumb in contact with the lid 2 and the index finger and the middle finger in contact with the sheet F2 on either side of the delivery duct 10'. In any event, whatever happens, it is not possible to push in the rear sheet F2 in register with the channel 10 in such a manner as to expel the fluid contained therein. As a result, the dispenser orifice 11 at the collection zone 12 is always completely clean after each use, providing the user has correctly cleaned the collection zone. In any event, the collection zone 12 cannot be soiled by fluid being expelled while the orifice 11 is being closed by the lid 2. This is a significant advantage of the present invention that is directly associated with the presence of the delivery channel 10 in the rear face.

In contrast to a delivery duct that is integrated in the thickness of the base body, the delivery channel is open along its entire length, thereby making it much easier to manufacture by injection-molding. Amongst other things, there is no need to use a molding pin in order to form the delivery duct 10'.

By means of the invention, a stopper member is made available that is particularly simple to mold, and that eliminates any risk of fluid being expelled or bleeding out while the dispenser orifice is being closed.

What is claimed is:

1. A stopper member for being sealed between two sheets of a fluid reservoir, said member comprising:

a base body defining a front face, a rear face, an internal edge, and an external edge, the body forming a fluid dispenser orifice that passes through the body from the rear face to the front face, the front and rear faces defining front and rear heat-sealing zones for being sealed to the two sheets, respectively, the front face defining a fluid collection zone at the dispenser orifice, the rear face defining a fluid delivery channel being open along its length and extending from the dispenser orifice to the internal edge of the base body, and a closure lid for closing the dispenser orifice of the base body on the front face, the lid being integrally connected to the base body via a hinge, wherein the body having tapered side edges where the front and rear heat-sealing zones are contiguous, and the front and rear faces being convex and defining a maximum thickness where the dispenser orifice, the delivery channel, and a fraction of the collection zone are formed.

2. A stopper member according to claim 1, wherein the front and rear heat-sealing zones surround the collection zone and the delivery channel respectively.

3. A stopper member according to claim 1, wherein the collection zone is hollowed out relative to the front heat-sealing zone.

4. A stopper member according to claim 1, wherein the delivery channel is hollowed out relative to the rear heat-sealing zone.

5. A stopper member according to claim 1, wherein the maximum thickness of the body is less than about 5 mm.

6. A stopper member according to claim 1, wherein the closure lid covers substantially all of the collection zone and is inscribed in the front face.

7. A stopper member according to claim 1, wherein the front face defines a projecting ridge that separates the front heat-sealing zone from the collection zone, the ridge being interrupted locally to define an access for gripping the lid.

8. A stopper member according to claim 1, wherein the lid is connected to the body via the hinge at the external edge.

9. A stopper member according to claim 1, wherein the delivery channel presents a width lying in the range about 2 mm to 7 mm, advantageously in the range about 4 mm to 5 mm.

10. A fluid dispenser comprising:

a fluid reservoir comprising two flexible sheets; and a stopper member according to claim 1, wherein the flexible sheets are heat-sealed on the front and rear heat-sealing zones respectively of the base body of the stopper member.

11. A dispenser according to claim 10, wherein one of the sheets extends over the delivery channel to define a delivery duct that connects the dispenser orifice to the internal edge.

* * * * *